United States Patent [19]

Waters

[11] Patent Number: 4,920,855

[45] Date of Patent: May 1, 1990

[54] BOLT ASSEMBLY FOR SELF-LOADING GUN

[76] Inventor: Frank E. Waters, Boxfield, Kimpton Avenue, Brentwood, Essex, England

[21] Appl. No.: 224,627

[22] Filed: Jul. 27, 1988

[30] Foreign Application Priority Data

Jul. 27, 1987 [GB] United Kingdom ..... 8717722

[51] Int. Cl.[5] ..... F41D 3/06

[52] U.S. Cl. ..... 89/172; 89/185

[58] Field of Search ..... 89/185, 172, 166, 181

[56] References Cited

U.S. PATENT DOCUMENTS

| | | | |
|---|---|---|---|
| 1,648,833 | 11/1927 | Vincon | 89/185 |
| 2,377,692 | 6/1945 | Johnson | 89/172 |
| 2,941,449 | 6/1960 | Reed | 89/185 |
| 3,996,684 | 12/1976 | Bauman et al. | 89/185 |
| 4,191,089 | 3/1980 | Zedrosser | 89/185 |
| 4,655,118 | 4/1987 | Bruderer et al. | 89/185 |

*Primary Examiner*—David H. Brown

*Attorney, Agent, or Firm*—Fleit, Jacobson, Cohn, Price, Holman & Stern

[57] ABSTRACT

A bolt assembly (1) for a self loading rifle comprises a rotating bolt (2) mounted in a bolt carrier (3), the bolt being provided with locking teeth (6) which, in use, interengage with teeth (7) on the barrel extension (8) of the weapon. The angular position of the bolt relative to the bolt carrier is controlled by a cam pin (9) which runs in a cam slot (10) in the bolt carrier. When the bolt is clear of the barrel extension it is locked in the correct angular position by a lever (11) which is pivotally mounted in the bolt carrier.

4 Claims, 2 Drawing Sheets

BOLT ASSEMBLY FOR SELF-LOADING GUN

This invention relates to a bolt assembly for a self-loading gun.

One type of bolt commonly employed in self-loading rifles is a rotating bolt which is formed at the leading end with a locking structure which, in use, interengages with a complementary locking structure of a barrel extension to lock the bolt in position as each round is fired. Immediately after each round is fired the bolt is rotated in one direction to release the interengagement with the locking structures and is then moved rearwardly to facilitate ejection of the spent case. The bolt then travels forward, carrying a fresh round into the chamber and, when it has reached its fully forward position, is rotated once again to interengage the locking structures of the bolt and the barrel extension prior to firing.

With such an arrangement, it is of course necessary that the angular position of the bolt as it moves forward towards the barrel extension is correct to enable the interengaging locking structures of the bolt and the barrel extension to slide through each other prior to rotation. This is conventionally achieved by providing the bolt with a cam pin which extends radially from the bolt to engage a channel which is welded to the interior of the receiver of the weapon. The channel controls the angular position of the cam pin and ensures that the bolt is correctly rotationally positioned to enter the barrel extension. Such an arrangement is shown, for example, in G.B.-A-1056056.

The above described arrangement suffers from the significant disadvantage that the cam pin is in sliding engagement with the channel during much of the movement of the bolt assembly. Even when there is no wear in any of the components and the gun is clean and well lubricated, the contact between the pin and the channel introduces undesirable frictional drag on the movement of the bolt assembly. However, operating conditions of assault weapons are frequently less than ideal, and if the cam pin and/or channel is dirty and/or poorly lubricated the problem of frictional drag is much greater. The situation is exacerbated further by any wear on the cam pin or channel. In this respect, it should be noted that because the channel is conventionally welded to the interior of the receiver it cannot be surface hardened by conventional heat treatment techniques.

According to one aspect of the present invention there is provided a bolt assembly for a self-loading gun, the bolt assembly comprising: a rotating bolt mounted in a bolt carrier for limited rotational movement relative thereto between a first extreme angular position in which the bolt is, in use, locked in engagement with a locking structure fast with the barrel of the gun, and a second extreme angular position in which the bolt is, in use, free to move axially relative to the barrel; a cam slot in said bolt carrier; a cam pin secured to the bolt and located in the cam slot whereby relative axial movement of the bolt and bolt carrier causes relative rotations movement thereof; and means on the bolt carrier for retaining the cam pin in the zone of the cam slot corresponding to the second extreme angular position of the bolt at all times when the bolt is clear of the locking structure.

With this arrangement there is no need to provide a channel on the inside of the receiver in order to guide the cam pin. The friction previously associated with the interengagement of the cam pin and the channel is accordingly completely removed.

In the preferred embodiment of the invention the cam pin is positively retained in the zone of the cam slot corresponding to the second extreme angular position of the bolt by a spring loaded lever pivotally mounted on the bolt carrier. The lever prevents movement of the cam pin out of the said zone of the cam slot until the lever is pivoted out of its normal operative position. Pivoting of the lever can conveniently be effected by providing a stud on the inside of the receiver which engages a surface on the lever to pivot the lever out of its normal operative position after the head of the bolt is received within the barrel extension and is accordingly ready to be rotated into its locked position.

Preferably, as the cam pin moves along the cam slot during rotation of the bolt it runs along a surface of the lever to pivot the lever out of engagement with the stud secured to the receiver. After firing, the arrangement is preferably such that the lever returns to its operative position before the bolt is fully unlocked from the barrel extension. With this arrangement, there is no possibility that the bolt will be able to adopt anything other than its second extreme angular position once it has been unlocked from the barrel extension. The desired arrangement can conveniently be achieved by making the cam-slot oversize relative to the cam pin so as to introduce some back-lash between the cam pin and the cam slot. Accordingly, the bolt carrier is able to move rearwardly sufficiently to enable the lever to resume its normal operative position before the cam surface which produces the unlocking rotation of the bolt has fully unlocked the bolt from the barrel extension.

The above and further features and advantages of the invention will be better understood from the following description of a preferred embodiment thereof, given by way of example only, reference being had to the accompanying drawings wherein.

Figure 1:
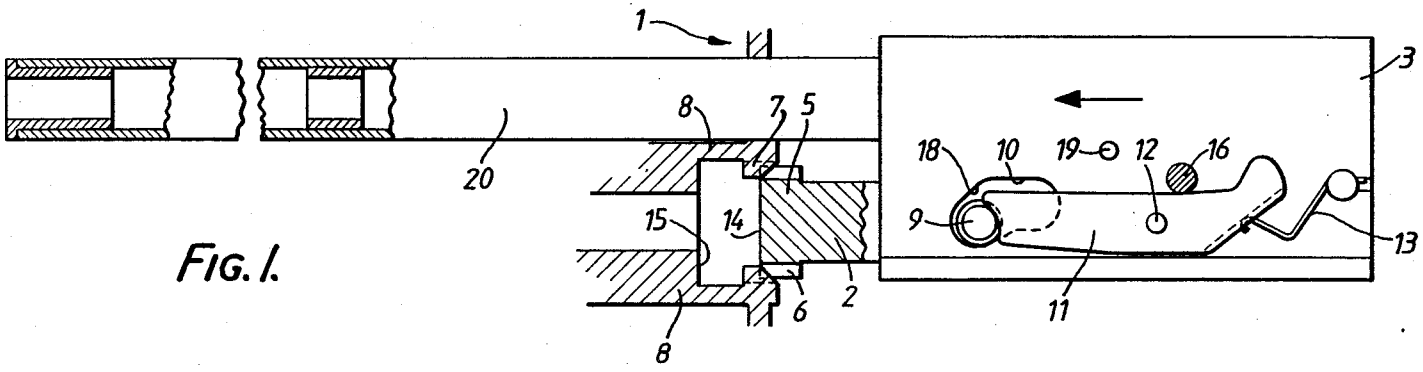
FIG. 1 illustrates schematically a preferred embodiment of bolt assembly according to the present invention with the bolt assembly moving forwardly and the head of the bolt entering the barrel extension.

Referring firstly to FIG. 1 there is shown a bolt assembly 1 comprising a rotating bolt 2 mounted in a bolt carrier 3. As will be understood by those skilled in the art the forward end 5 of the bolt is formed with locking teeth 6 which, when the bolt is in the rotational position illustrated in FIG. 1 can pass between complementary locking teeth 7 provided on a barrel extension 8 of the weapon. After the teeth 6 of the bolt have moved forwardly of the teeth 7 of the barrel extension the bolt can be rotated through a small angle until each tooth 6 of the bolt is aligned with a tooth 7 of the barrel extension, whereby the bolt is locked in position for firing.

The angular position of the bolt is controlled by a cam pin 9 which is secured to the bolt and extends into and through a cam slot 10 formed in the bolt carrier.

A lever 11 is pivotally mounted on the bolt carrier to rotate about an axis 12. A spring 13 also mounted on the bolt carrier biases the lever 11 in an anti-clockwise direction as viewed in the Figures and accordingly the lever 11 normally maintains the cam pin in the zone of the cam slot nearest the left-hand end of the cam slot, as viewed in the drawings. With the cam pin in this position the locking teeth of the bolt are aligned with the spaces between the locking teeth on the barrel extension, and accordingly the bolt is free to pass between the locking teeth of the barrel extension as the bolt assembly moves forwardly to carry a round (not shown) into the chamber of the weapon.

Because the lever 11 and spring 13 are mounted on the bolt carrier, the arrangement illustrated in the drawings is effective to maintain the cam pin 9 in the desired position relative to the bolt carrier throughout the portion of the operating cycle which commences with the bolt leaving the barrel extension after a round has been fired, and ends with the bolt re-entering the barrel extension to carry a fresh round into the chamber. This contrasts with the prior art as outlined above in which a channel welded to the inside of the receiver was used to locate the cam pin during this portion of the operating cycle of the weapon.

Operation of the above described bolt assembly will now be described with reference to the drawings. Referring firstly to FIG. 1, the bolt assembly is shown moving towards the left, i.e. in the firing direction. Normally, the bolt would at this point in the operating cycle be carrying a round into the chamber. However, the round has been omitted in the interests of clarity. As viewed in FIG. 1, the locking teeth of the bolt have just entered the spaces between the locking teeth on the barrel extension, and the bolt and bolt carrier are moving as a unit with the cam pin held in the zone of the cam slot 10 corresponding to the desired bolt orientation by the lever 11.

Figure 2:
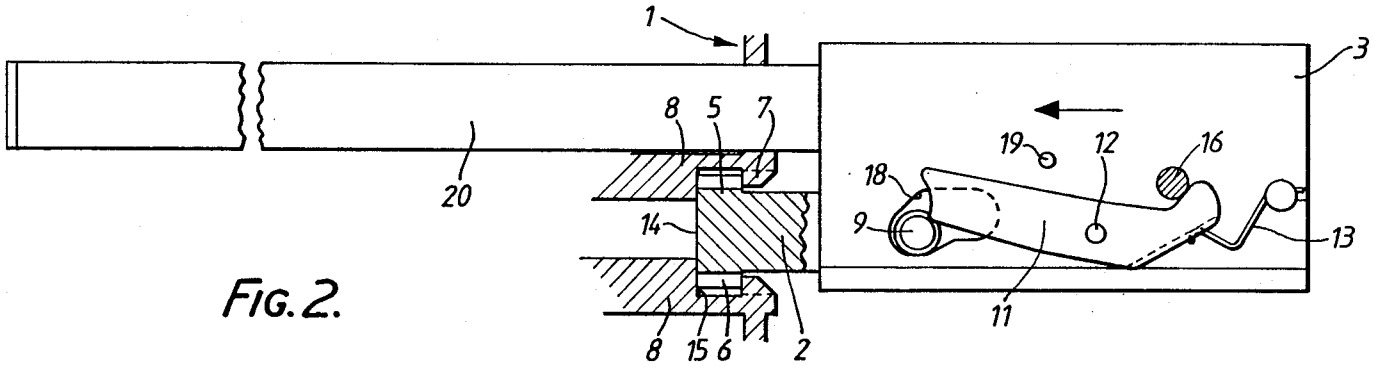
FIG. 2 shows the bolt assembly of FIG. 1 with the bolt fully forward and rotation of the bolt commencing.
Figure 3:
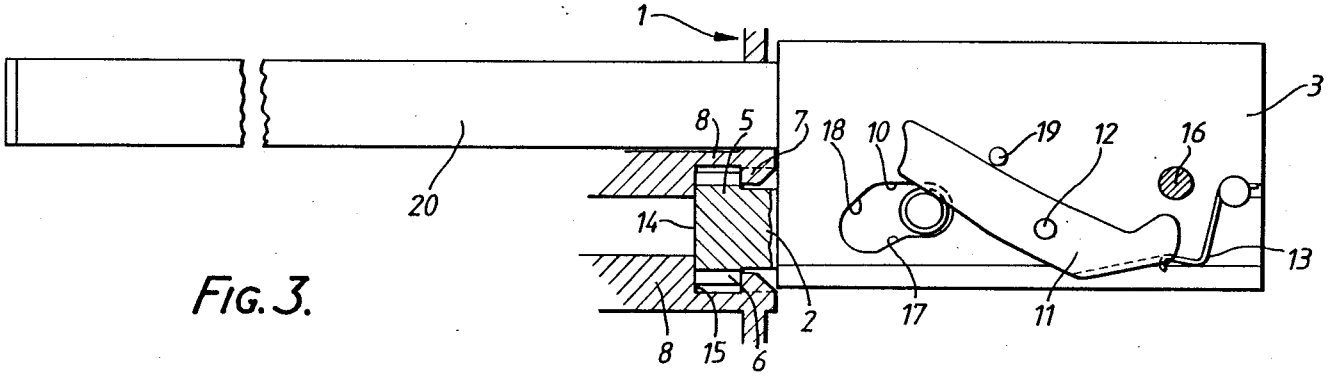
FIG. 3 shows the arrangement of FIG. 1 with the bolt fully locked.

Shortly before the leading face 14 of the bolt engages the rearwardly directed face 15 of the barrel extension the lever 11 is pivoted by engagement with a stud 16 secured to the inside of the receiver so that at the moment when the faces 14 and 15 engage each other the lever 11 is in the position illustrated in FIG. 2. Further forward movement of the bolt is then prevented but continued forward movement of the bolt carrier under the influence of the main spring causes the cam surface 17 of the cam slot 10 to act on the cam pin 9 to rotate the bolt into the locked position. As the cam pin 9 travels along the cam slot 10 it lifts the lever 11 out of engagement with the stud 16, and accordingly when the bolt reaches the fully locked position the components are in the configuration illustrated in FIG. 3.

Figure 4:
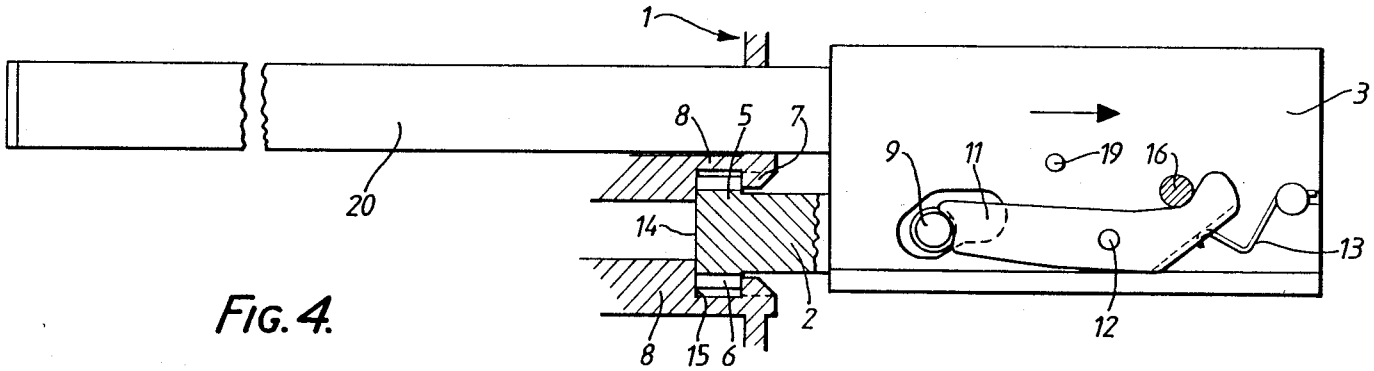
FIG. 4 illustrates the arrangement of FIG. 1 with the bolt carrier moving rearwardly and immediately before the complete release of the bolt from the barrel extension.

When the weapon is fired the bolt carrier 3 is driven rearwardly by a suitable gas-operated mechanism. This causes the cam surface 18 of the slot 10 to engage the cam pin 9 and rotate the bolt in the opposite direction to that in which it was previously rotated. This in turn permits the lever 11 to pivot in an anti-clockwise direction under the influence of the spring 13. The cam slot 11 is preferably somewhat wider than the cam pin 9 with the result that there is some lost motion between the cam pin and the slot. This enables the lever to be returned to its operative position when the cam pin achieves the position illustrated in FIG. 4. In this position, the bolt is not yet fully unlocked, and further rotation of the bolt by the cam surface 18 is required before the bolt is released from the barrel extension. The fact that the lever can return to its operative position before the bolt is fully unlocked precludes any possibility that the cam pin 9 might bounce off the end of the slot 10 and rebound to the position illustrated in FIG. 3 before the lever was able to lock the pin in the desired position for the remainder of the operating cycle.

It will be noted that a stop 19 is secured to the bolt carrier 3 to limit clockwise (as viewed in the drawing) rotation of the lever 11. It will also be noted that a gas cylinder 20 is secured to the bolt carrier 3. The gas cylinder cooperates with a fixed piston to provide the rear ward force necessary to move the bolt assembly in use from its fully forward position illustrated in FIG. 3 to its fully rearward position. To this end, a passage extends from the barrel of the gun via the piston to the interior of the cylinder 20 to charge the cylinder with high pressure gas as the weapon is fired as will be understood by those skilled in the art. Rearward movement of the bolt assembly compresses spring means, (not shown) preferably a single coil spring, to provide the forward force necessary for subsequent forward movement of the bolt assembly.

I claim:

1. A bolt assembly for a self-loading gun, the bolt assembly comprising:

a rotating bolt having a head and mounted in a bolt carrier for limited rotational movement relative thereto between a first extreme angular position in which the bolt is, in use, locked in engagement with a locking structure fast with the barrel of the gun, and a second extreme angular position in which the bolt is, in use, free to move axially relative to the barrel;

a cam slot in said bolt carrier;

a cam pin secured to the bolt and located in the cam slot whereby relative axial movement of the bolt and bolt carrier causes relative rotational movement thereof; and means on the bolt carrier for retaining the cam pin in the zone of the cam slot corresponding to the second extreme angular position of the bolt at all times when the bolt is clear of the locking structure, said retaining means comprising a lever pivotally mounted on the bolt and spring biased into a normal position in which an end face of the lever engages the cam pin to prevent the cam pin from leaving the zone of the cam slot corresponding to the second extreme angular position of the bolt, and means for pivoting the lever out of said normal position to disengage said end face from the cam pin after the head of the bolt is received within an extension of said barrel.

2. A bolt assembly as claimed in claim 1 wherein the cam slot is oversize relative to the cam pin so that the bolt carrier is able to move rearwardly relative to the bolt to an extent sufficient to allow the lever to return to said normal position before the bolt has been fully unlocked from the barrel extension.

3. A bolt assembly as claimed in claim 1 wherein pivoting of the lever is, in use, effected by a stud on the inside of the receiver of the gun which engages a surface of the lever to pivot the lever out of said normal position after the head of the bolt is received within the barrel extension.

4. A bolt assembly as claimed in claim 3, and further comprising a sliding surface on said lever and wherein said cam pin runs along said sliding surface to pivot the lever out of engagement with the stud as the cam pin moves along the cam slot during rotation of the bolt.

* * * * *